US005960905A

United States Patent [19]

Gardner

[11] Patent Number: 5,960,905

[45] Date of Patent: Oct. 5, 1999

[54] LADDER ACCESSORY DEVICE

[76] Inventor: Brady I. Gardner, R.R. 5, Box 447, Muncy, Pa. 17756

[21] Appl. No.: 09/027,850

[22] Filed: Feb. 23, 1998

[51] Int. Cl.[6] ..... E04G 1/00

[52] U.S. Cl. ..... 182/129; 248/210; 248/238

[58] Field of Search ..... 182/115, 116, 182/129; 248/210, 211, 238; 220/570; D32/53.1

[56] References Cited

U.S. PATENT DOCUMENTS

| | | | |
|---|---|---|---|
| 3,495,683 | 2/1970 | Broden | 182/129 X |
| 3,590,949 | 7/1971 | Monroe . | |
| 3,895,772 | 7/1975 | Ellingson . | |
| 3,950,796 | 4/1976 | Hollingsworth . | |
| 4,121,692 | 10/1978 | Morawski | 182/129 |
| 4,418,793 | 12/1983 | Brent . | |
| 4,445,659 | 5/1984 | LaChance | 248/210 |
| 4,489,911 | 12/1984 | Riley . | |
| 4,515,242 | 5/1985 | LaChance | 248/238 X |
| 4,660,794 | 4/1987 | Given . | |
| 4,662,594 | 5/1987 | Dubis . | |
| 4,913,394 | 4/1990 | Schmid | 248/238 |
| 5,031,723 | 7/1991 | Hooten | 182/129 |
| 5,079,795 | 1/1992 | Schmid . | |
| 5,135,193 | 8/1992 | Parris | 248/238 |
| 5,259,525 | 11/1993 | Wion | 248/210 X |
| 5,370,263 | 12/1994 | Brown | 248/210 X |
| 5,390,888 | 2/1995 | Rogers . | |
| 5,413,191 | 5/1995 | Kerr . | |
| 5,481,988 | 1/1996 | Dess . | |
| 5,505,302 | 4/1996 | Ferley | 182/129 X |
| 5,797,571 | 8/1998 | Brophy | 248/210 |

*Primary Examiner*—Daniel P. Stodola
*Assistant Examiner*—Richard M. Smith
*Attorney, Agent, or Firm*—Chase & Yakimo, L.C.

[57] ABSTRACT

An accessory device capable of being mounted on a ladder having hollow rungs includes a pair of primary support arms which are shaped to fit within rungs having flat top sides to prevent rotation of the primary arms therein. Secondary support arms are slidably extensible from the primary support arms to laterally position a tray assembly relative to one side of the ladder. A brace connected to the secondary support arms engages a tray assembly. The level of the tray relative to the slope of the ladder is adjusted by varying the position of arcuate slots found within a pair of flanges mounted on the bottom side of the tray relative to the brace. Thus, a user can adjust the level of the tray while keeping one or both hands on the tray for stability. The device may be mounted to either side of the ladder with the supporting arms and brace optionally remaining mounted on the ladder during transport and/or storage.

19 Claims, 7 Drawing Sheets

FIG. 7A
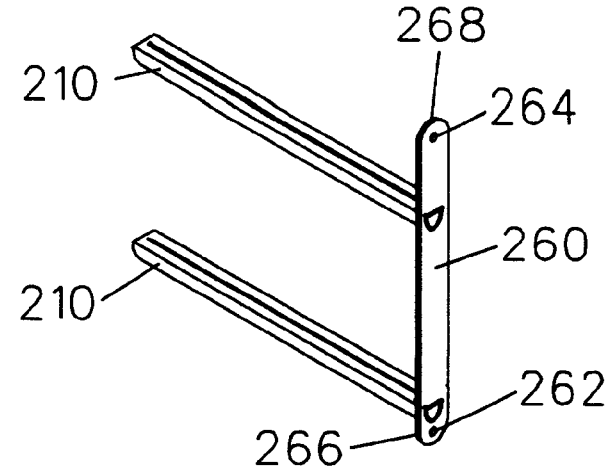
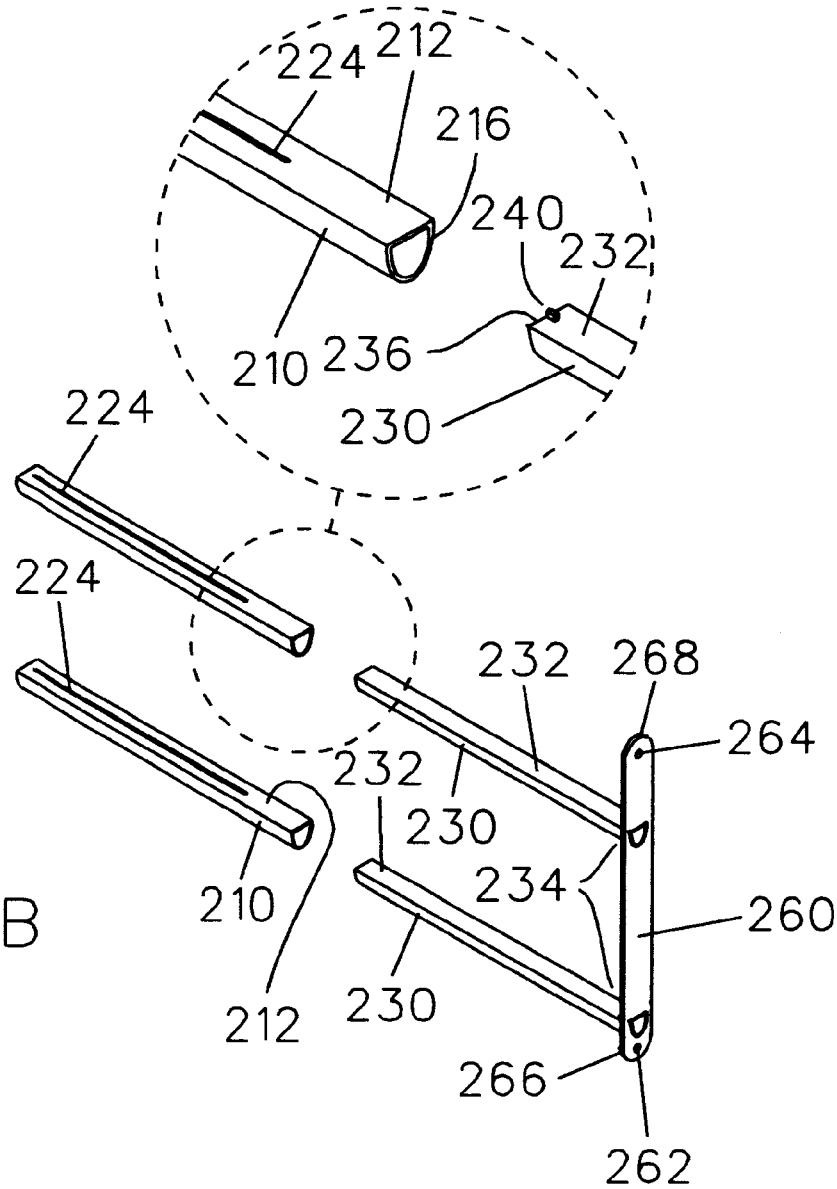
FIG. 7B

LADDER ACCESSORY DEVICE

BACKGROUND OF THE INVENTION

This invention relates to an accessory tray for ladders and, more particularly, to an adjustable tray for holding paint cans, tools and the like of improved stability.

Painters, carpenters, and other tradesmen often require ladders to accomplish their work. Such workers constantly experience the difficulty of safely holding and using a myriad of tools and materials while standing on the ladder. Workers must either make frequent trips up and down the ladder to obtain needed items or attempt to carry everything up the ladder at the same time.

Various devices have been proposed which attach to hollow rung ladders for holding tools and supplies. U.S. Pat. No. 4,489,911 to Riley, however, is representative of a common problem with existing ladder accessory trays. Tray support arms which are inserted into hollow rungs of a ladder are typically secured only by screwable fasteners which can loosen over time, allowing the support arms to rotate and the tray to suddenly slope or even fall from the ladder. U.S. Pat. No. 4,660,794 to Given seeks to overcome this problem by utilizing specifically machined, and presumably expensive, hardware to prevent arm rotation.

In addition, it is difficult for one person to maintain or adjust the horizontal position of a ladder tray while tightening the support arms where the tightening means is significantly displaced from the tray itself. Failure to keep the tray level during adjustment may result in falling paint cans and tools, the results of which can be costly and dangerous. A further disadvantage of existing devices is that the entire device, including support arms, typically must be removed from the ladder during transport and/or storage.

It is therefore desirable to have a ladder accessory device for holding tools and materials having a means of securement to a hollow rung ladder such that rotation of supporting arms within the rungs is prevented. The secondary means of securement should not require any special hardware. It is further desirable that the tray be conveniently adjustable to maintain a level position without a worker having to dismount from the ladder or unload the tray. In addition, it is desirable that the supporting arms within the rungs optionally remain in the ladder during transport and/or storage.

SUMMARY OF THE INVENTION

In response thereto, I have invented a ladder accessory device which utilizes a pair of primary support arms which are particularly shaped to fit within ladder rungs, e.g. those having planar top sides so as to enhance the user's footing. Primary support arms are inserted within ladder rungs and then secured by screwable fasteners so as to preclude lateral movement of the arms. The contour of the primary support arms within the rungs prevents rotation of the support arms without expensive specially-machined hardware. Secondary support arms slide within the primary support arms to laterally position a tray assembly relative to the ladder. The secondary support arms are attached to a tray support brace. The secondary support arms can be entirely nested within the primary support arms with the brace resting against one leg of the ladder for transport and/or storage.

The orientation of the tray assembly is provided by arcuate slots in a pair of flanges mounted to the underside of the tray and about a fastener's pivot axis, e.g., a bolt of a bolt/nut combination, extending through the brace. Upon loosening the fastener/nut, a user can pivot/adjust the position of the tray while keeping both hands on the bottom of the tray for stability. The tray holds and secures tools, materials, and other accessories.

It is therefore a general object of this invention to provide a ladder accessory device which mounts to hollow rungs of a ladder for holding tools, materials, and accessories at a desired height.

Another object of this invention is to provide a ladder accessory device, as aforesaid, having support arms configured to prevent their rotation when inserted into the rungs of a ladder.

Still another object of this invention is to provide a ladder accessory device, as aforesaid, having primary and secondary slidable support arms which cooperate to laterally position a tray assembly relative to a side of a ladder.

A further object of this invention is to provide a ladder accessory device, as aforesaid, presenting a tray which can be adjusted to a desired position while keeping one or both hands on the tray for stability.

A still further object of this invention is to provide a ladder accessory device, as aforesaid, having a detachable tray assembly which allows the support arms to remain in the ladder rungs during transport and/or storage.

Yet another object of this invention is to provide a ladder accessory device, as aforesaid, which is mountable to either side of a hollow rung ladder.

A still further object of this invention is to provide a ladder accessory device, as aforesaid, which is easier and more cost-effective to manufacture than ladder accessory devices having specially machined mounting means.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 7A is an isometric view of the support arm assembly showing the slidable arms completely within the fixed arms.

FIG. 7B is an isometric view of the support arm assembly showing the fixed support arms completely removed from the slidable arms with an enlarged isolated view of a guide slot in the fixed support arm flange at the end of the slidable support arm.

DESCRIPTION OF THE PREFERRED EMBODIMENT

Figure 1:
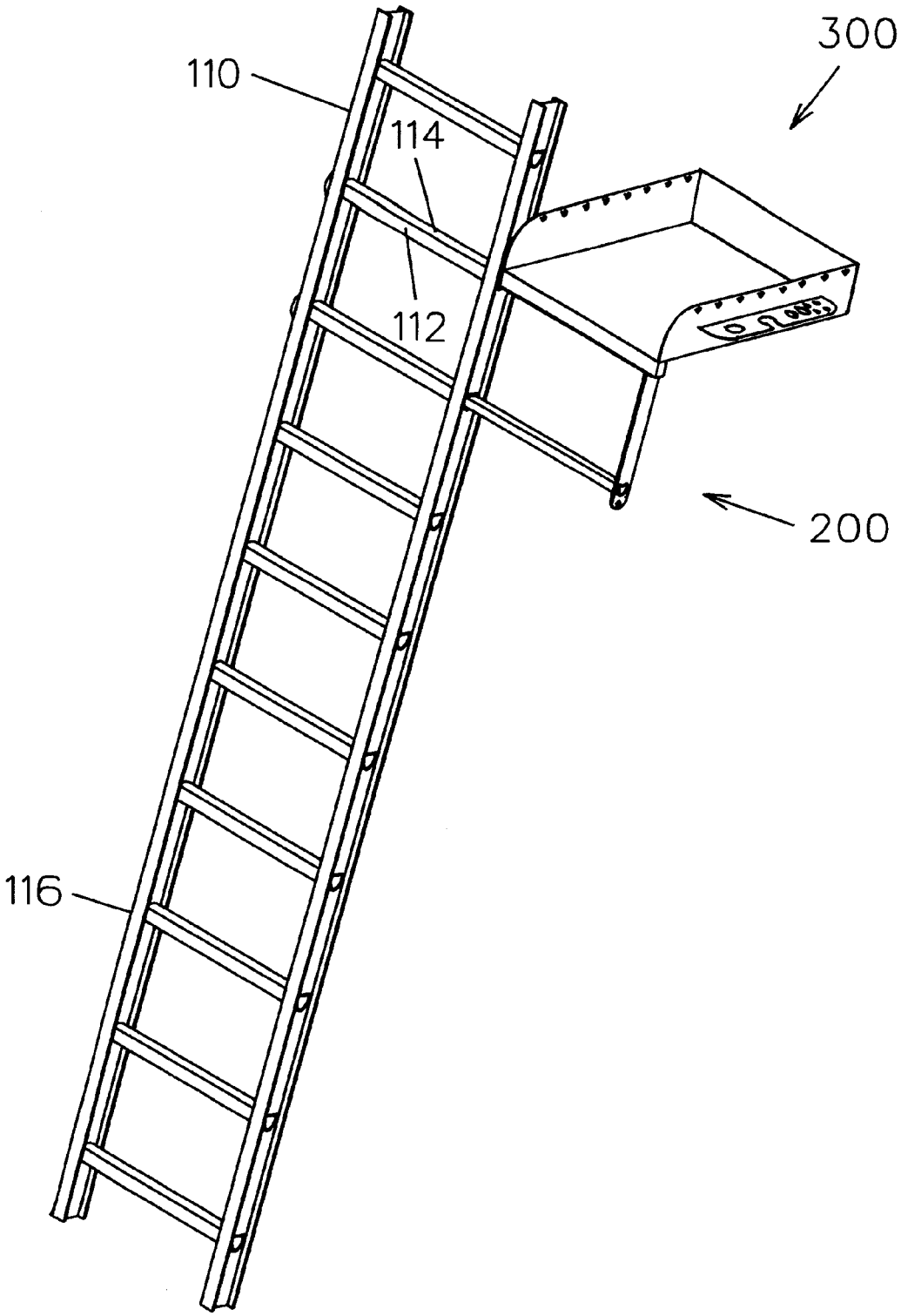
FIG. 1 is an isometric view of the ladder accessory device attached to a hollow rung ladder.
Figure 2:
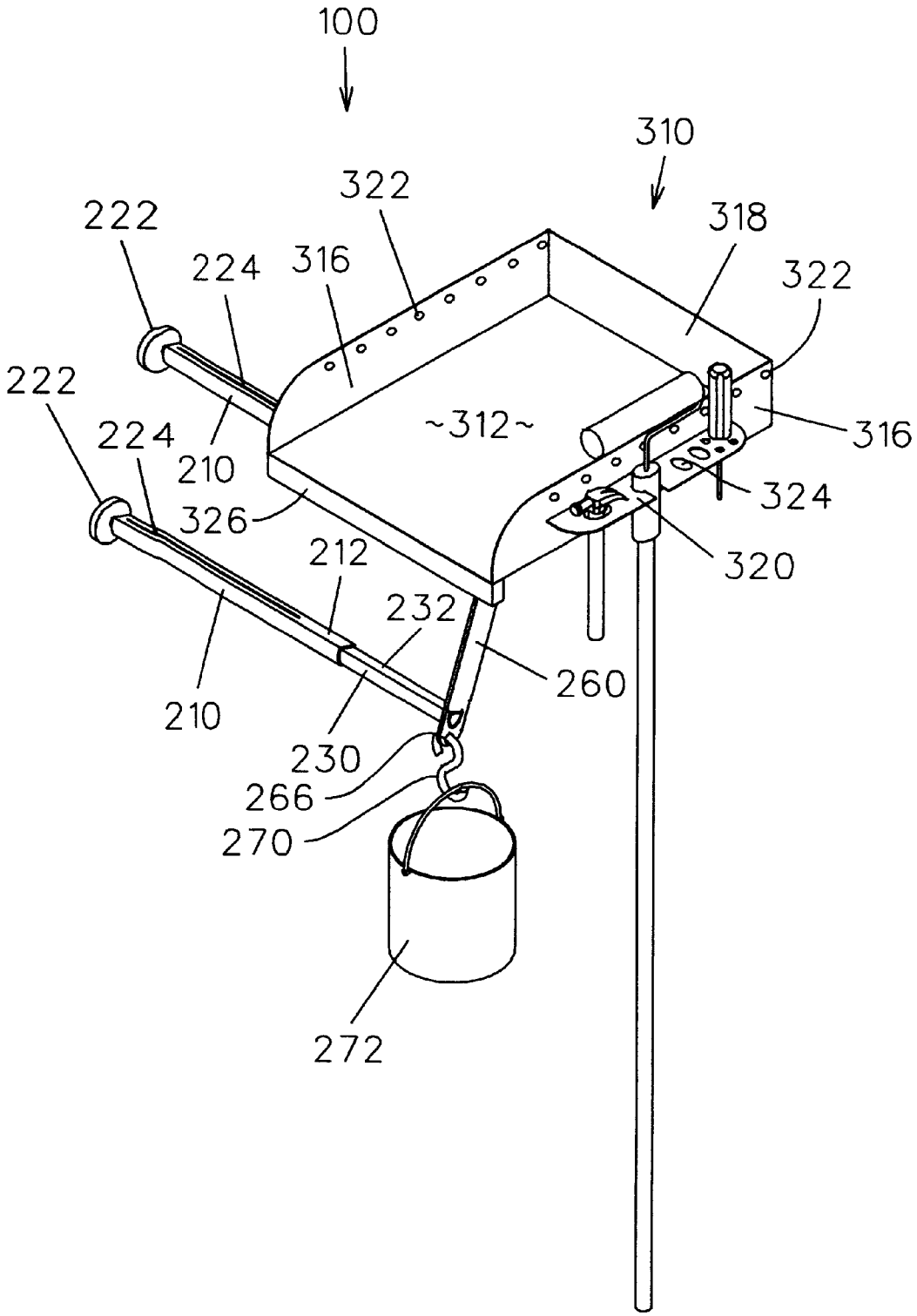
FIG. 2 is an isometric view, on an enlarged scale, of the ladder accessory device of FIG. 1 removed from the ladder.
Figure 3:
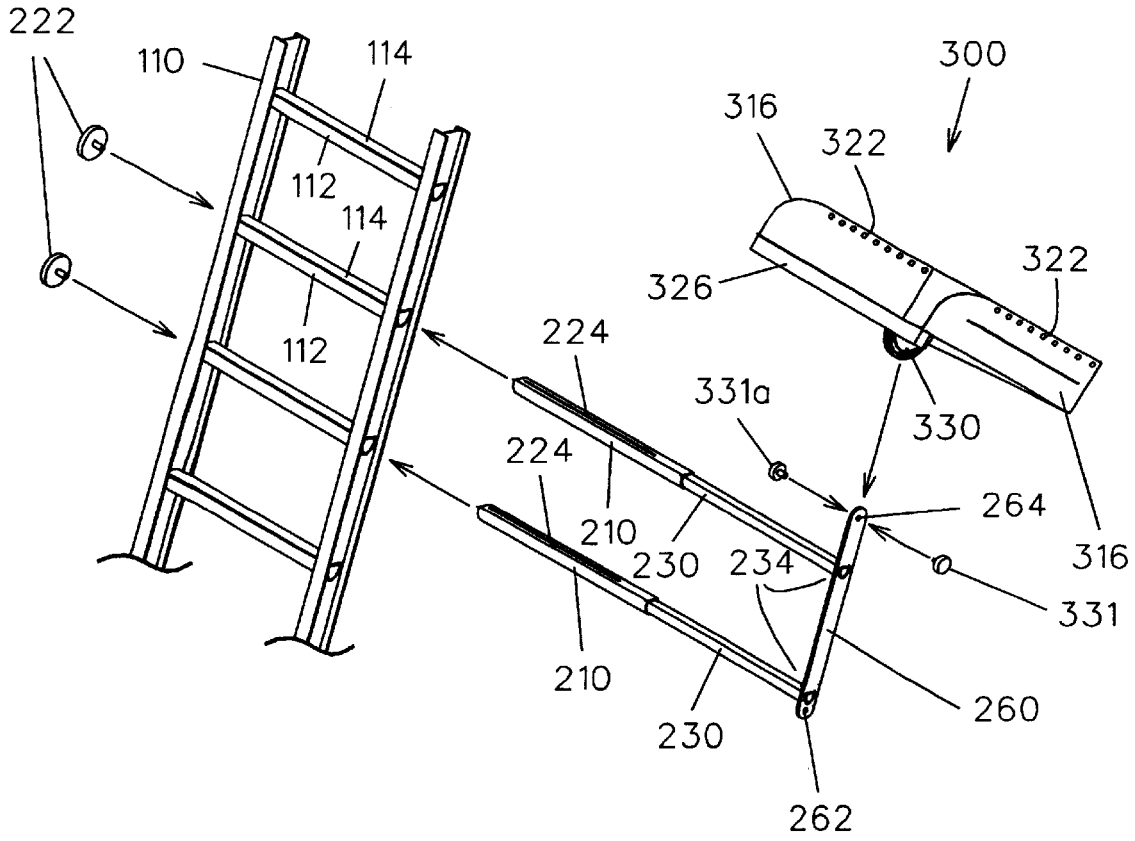
FIG. 3 is an isometric view of the ladder accessory device exploded from the ladder.

Turning more particularly to the drawings, FIGS. 1–3 show the ladder accessory device 100 comprising a support assembly 200 and tray assembly 300 for attachment to a hollow rung ladder 110 having generally cylindrical rungs 112 with planar top sides 114. The support assembly 200 includes a first pair of generally cylindrical hollow support arms 210, said first arms 210 presenting planar top sides 212. The support assembly 200 is mounted to a ladder 110 by simultaneously inserting first arms 210 into adjacent rungs 112 of the ladder 110. The planar top sides 212 of first arms 210 cooperate with the planar top sides 114 of the rungs 112 to prevent rotation of first arms 210 within the rungs 112. It is understood that hollow rung ladders having rungs with planar top sides are known in the art.

Figure 6:
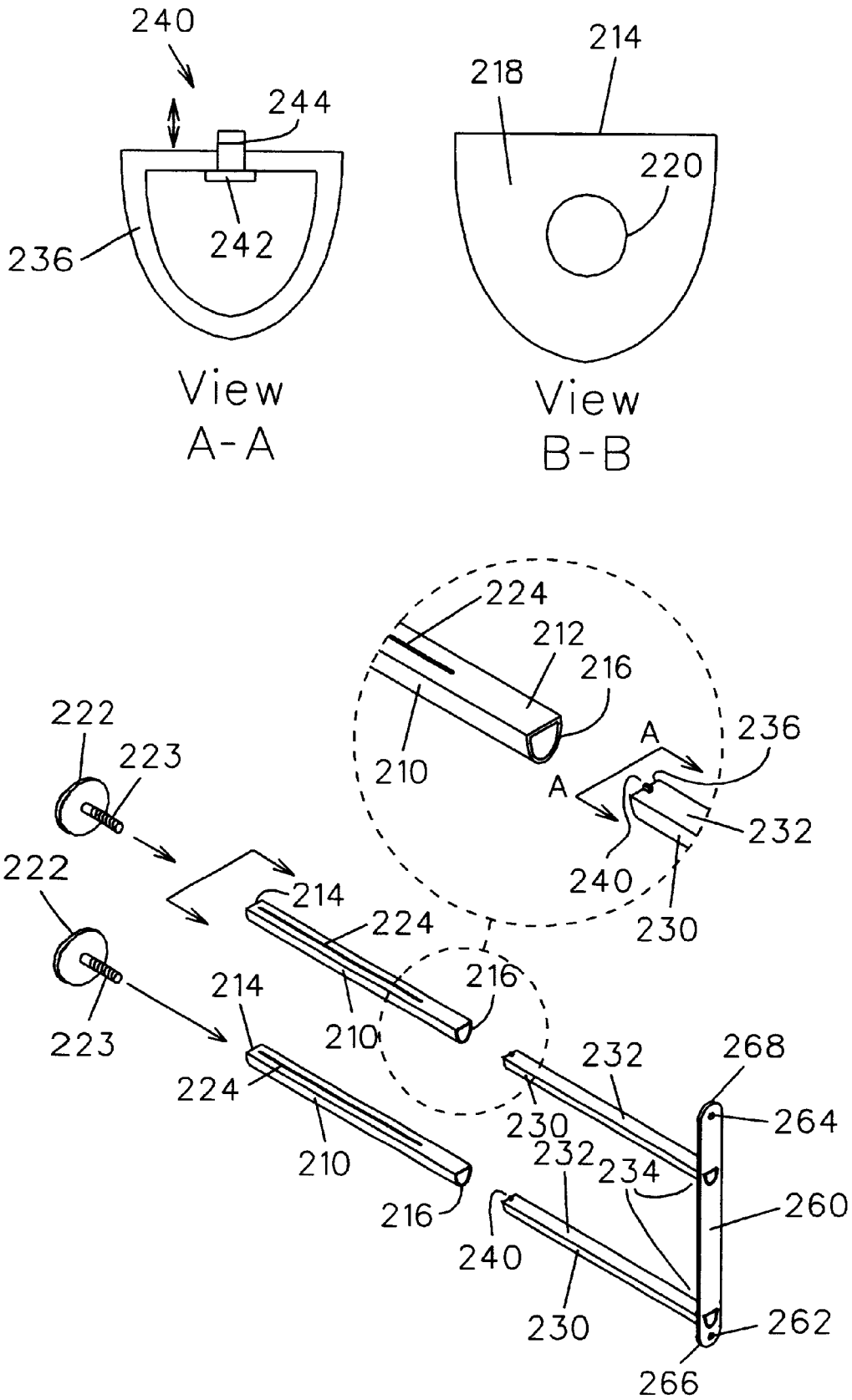
FIG. 6 is an isometric view of the support arm assembly with an enlarged isolated view of the guide slot in the fixed arm and flange in the slidable arm, the end of the slidable arm and fixed arm being shown as taken from planes A—A and B—B, respectively.

First arms 210 include end walls 218 (FIG. 6) at first arm ends 214 thereof, said end walls 218 presenting threaded apertures 220 which screwably receive corresponding threaded 223 knobs 222 for securing first arms 210 at one stile 116 of the ladder 110 (FIG. 6). This engagement thereby prevents lateral movement of first arms 210 and the tray assembly 300 relative to the surrounding rung 112. Each planar top side 212 of first arms 210 includes an elongated slot 224, said slot 224 ends being displaced from first 214 and second 216 ends of first arms 210, the slot 224 extending therebetween for receiving and guiding a pin/flange 240 as more fully described later.

As shown in FIGS. 6–7, the support assembly 200 further includes a second pair of generally cylindrical hollow support arms 230, said second arms 230 presenting planar top sides 232. One end 234 of each second arm 230 is normal to a brace 260 and fixedly attached thereto, said brace 260 thereby holding second arms 230 in parallel. The brace 260 presents an aperture 262 in a first lower end 266 thereof suitable for receiving an S-hook 270 or the like for suspending a paint can 272 or other accessory therefrom (FIG. 2). First arms 210 present an interior bore having a configuration that is slightly larger than the exterior configuration of second arms 230, said first arms 210 receiving second slidable arms 230 therein.

At the free second end 236 of second arm 230 is a flange 240 comprising a mounting strip 242 and upstanding pin 244 (FIG. 6, view A—A). The mounting strips 242 are attached to the underside of the planar top side 232 of second arm 230, the point of attachment being displaced from the second end 236 thereof. The upstanding pin 244 of the flanges 240 are normal to the mounting strips 242 and extend through the planar top sides 232 of second arms 230. In function, the pin 244 of flanges 240 may be in the form of a pushbutton, a manual depression thereof allowing the second arms 230 to be initially slidably insertable within first arms 210. The free pin ends 244 return to their non-depressed state when the free pin ends 244 are received by the slots 224. Upon the pin 244 extending into the slot 224 the flange bears against the slot walls in a friction fit relationship therebetween. This relationship precludes slidable movement of the pin within the slot 224 and movement of the second slidable arm 230 within the fixed first arm 210 absent a user exertion on the second arm 230. The pin 244 is user slidable along the slot 224 upon a user exertion on the slidable arm 230. Absent such user exertion the pin 244 bears against the slot 224 walls so as to maintain the flange at its relative slot 224 position and thus the extensible relationship of the second arm 230 with the first arm 210. Second arms 230 are thereby slidable within first arms 210 and maintained thereat for laterally positioning a tray assembly 300 relative to the ladder 110. It is understood that as a manual depression of the pins 244 of the flanges 240 are required to disengage the support arms 210, 230 the entire support assembly 200 can remain mounted to a ladder during transport and/or storage (FIG. 7A). (It is noted that a slot may be cut in the top side 114 of each ladder rung 112 such that the slidable arm 230 may be inserted within the rung 112 with no need for a fixed arm 210.)

Figure 4A:
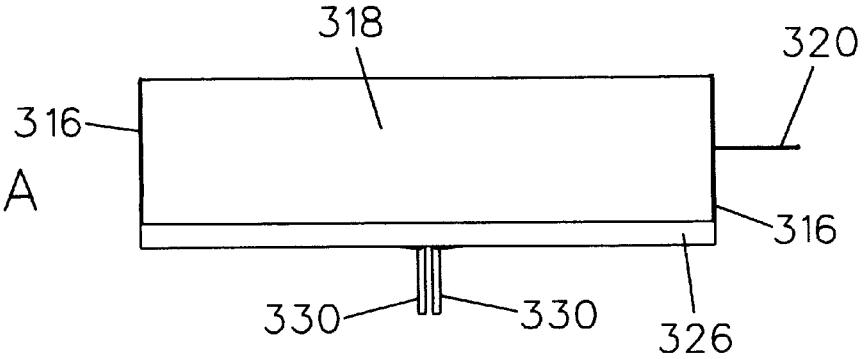
FIG. 4A is a front view of the tray assembly of the ladder accessory device.
Figure 4B:
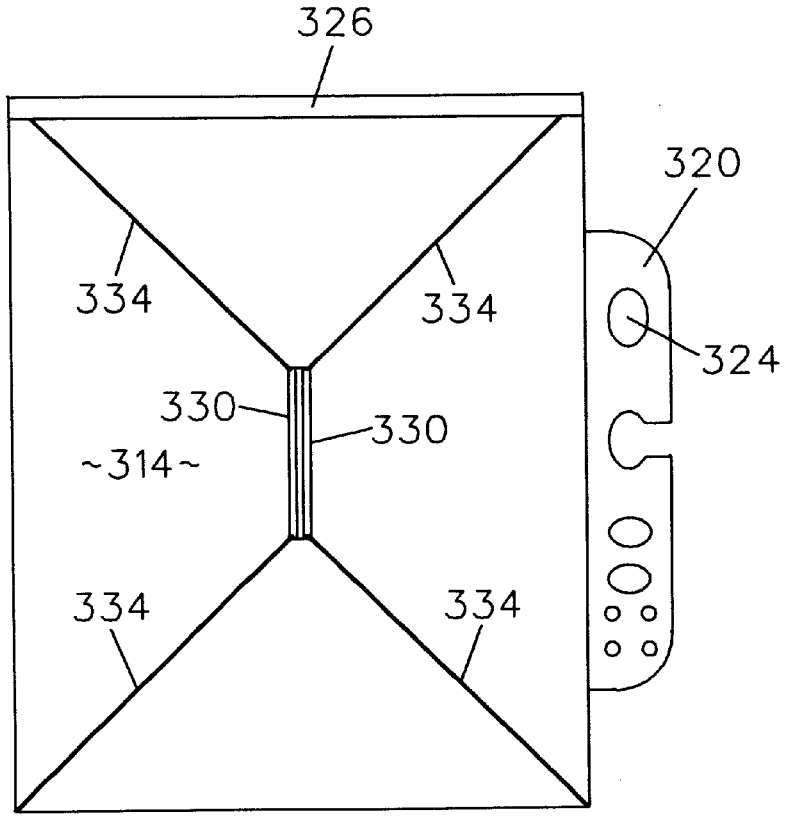
FIG. 4B is a bottom view of the tray assembly of the ladder accessory device.
Figure 5A:
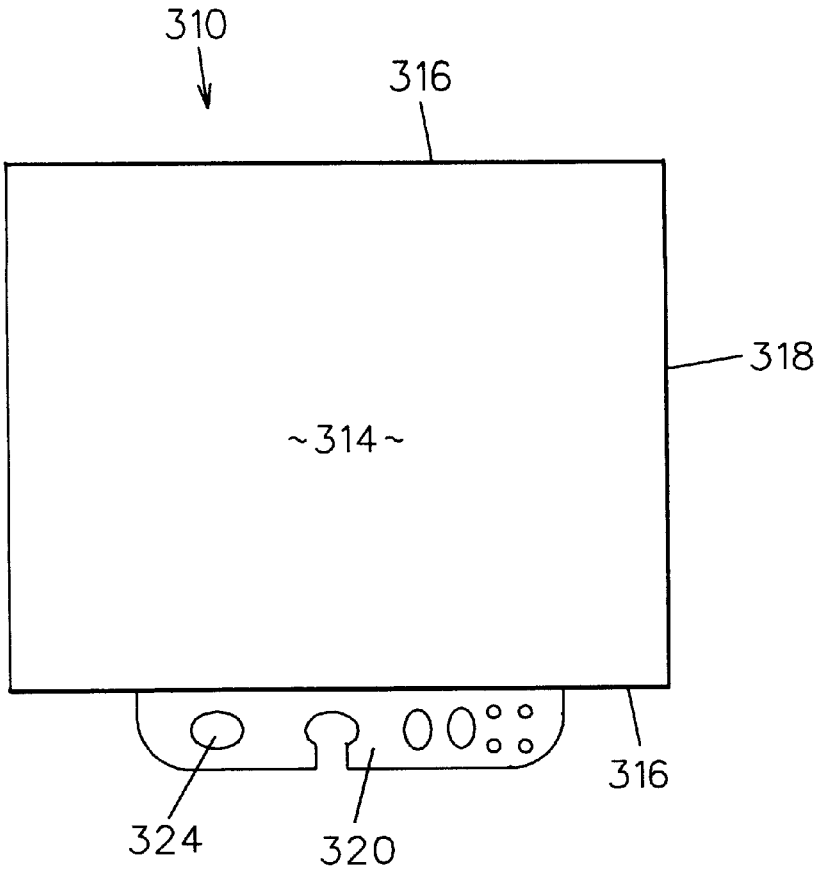
FIG. 5A is a top view of the tray assembly of the ladder accessory device.
Figure 5B:
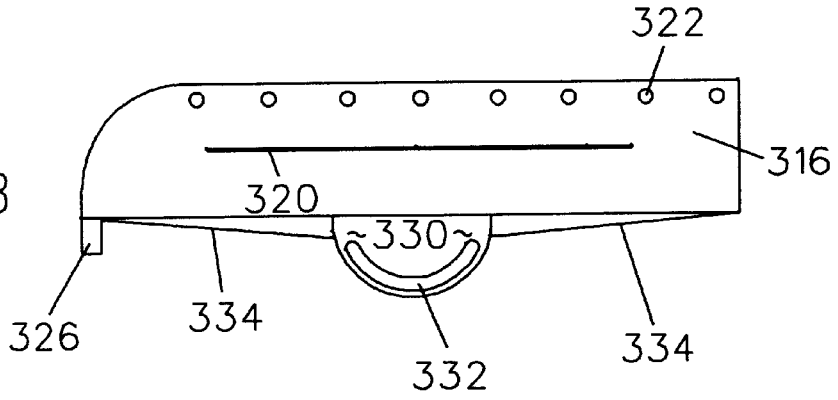
FIG. 5B is a side view of the tray assembly of the ladder accessory device.

Turning to FIGS. 2, 4–5, the tray assembly 300 includes a tray 310 having a bottom wall 312 integrally attached to oppositely disposed upstanding side walls 316 with an upstanding end wall 318 intermediate said side walls 316. The side walls 316 present laterally spaced apart apertures 322 suitable for receiving hooks from a bungee cord or the like (not shown) for securing accessory items to the tray 310 or hanging tools over the side of the tray 310. An outwardly extending panel 320 is normal to at least one side wall 316, said panel 320 having a plurality of apertures 324 of varying dimensions for holding tools or other accessories. A depending flange 326 is normal to the bottom wall 312 of the tray 310 and integrally attached to the bottom side 314 thereof, said flange 326 suitable for engaging the clips found on the underside of a standard paint tray (not shown) when the paint tray is placed on the bottom wall 312 of the tray 310.

The tray assembly 300 further includes a pair of parallel hemispherical flanges 330 (FIGS. 3, 4A) depending from the bottom side 314 of the bottom wall 312 of the tray 310, said flanges 330 having arcuate slots 332 (FIG. 5B) about the perimeter thereof. The tray 310 further includes rods 334 fixedly attached to a bottom side 314 thereof, said rods 334 taperedly extending between the corners 336 and flanges 330 for strengthening the tray 310 (FIG. 4B).

In mounting the tray assembly 300 to the support assembly 200, the brace 260 of the support assembly 200 is sandwiched between the flanges 330, the aperture 264 in the brace 260 registering with the slots 332 in the flanges 330. The brace 260 and flanges 330 are thereby releasably joined in a friction fit arrangement by passing male/female fasteners 331, e.g., a bolt/nut combination or the like, through the slots 332 and aperture 264 and tightening the same. The male fastener may be in the form of a bolt 331 which extends through the slots 332 and aligned aperture 264. Thus, a pivot axis is provided for flanges 330. The female fastener 331*a* would be in the form of a wing nut or the like. The orientation of the tray 310 is thereby adjustable by loosening the fasteners 331 to reduce pressure on flanges 330, and pivoting the slots 332 of flanges 330 about the axis until the tray 310 is level. Once positioned the fasteners 331 are tightened to bear against the flanges 330 and brace end therebetween to preclude pivotal movement of tray 310. A worker can therefore adjust the tray while keeping one or both hands in contact with the underside of the tray for stability.

Accordingly, it can be seen that the ladder accessory device prevents lateral and/or rotatable movement of the support arms within the hollow ladder rungs. Further, the tray is easily adjustable by a user to a level position regardless of the slope of the ladder while keeping one or both hands on the tray for enhanced stability. The lateral position of the tray assembly relative to a side of the ladder is also adjustable by the slidable cooperating support arms 230. The tray can be easily released to allow the support assembly to remain mounted to the ladder during transport and/or storage.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An accessory device for installation on a ladder having hollow rungs extending through a pair of spaced-apart rails comprising:

a first arm assembly having a configuration for insertion within a first hollow rung of a ladder, said first arm assembly comprising:

a fixed arm adapted for insertion within the respective first hollow rung;

a slidable arm within said fixed arm and slidable between a first position within said fixed arm and a second position extensible from said fixed arm;

a second arm assembly having a configuration for insertion within a second hollow rung of the ladder, said second arm assembly comprising:

a fixed arm adapted for insertion within the respective second hollow rung;

a slidable arm within said fixed arm and slidable between a first position within said respective fixed arm and a second position extensible from said respective fixed arm;

a slot in each said fixed arm;

pin means on each said slidable arm for engagement with said slot, said pin means slidable along said slot upon a user exertion on said slidable arms, said pin means engagement with said slot precluding a relative movement between said fixed and slidable arms absent a user exertion on said slidable arms;

a brace extending between said slidable arms of said first and second arm assemblies;

an aperture in said brace;

an accessory tray having a base;

at least one flange depending from said tray base;

an aperture in said at least one depending flange;

fastener means for defining a pivot axis extending through said brace and flange apertures upon alignment therebetween, a first mode of said fastener means urging said at least one flange against said brace for precluding pivotal movement of said at least one depending flange about said axis, a second mode of said fastener means displacing said at least one flange from said brace for allowing for said pivotal movement, whereby to allow for a selectable pivotal movement of said flange and said tray about said axis and with said slidable arms a desired lateral movement of said tray relative to the ladder.

2. The device as claimed in claim 1 further comprising a fastener adapted for attachment to a free end of each said fixed arm upon said rung insertion, said fastener attachment precluding lateral movement of said respective fixed arm within the respective rung.

3. The device as claimed in claim 1 wherein each said fixed arm further comprises a top side adapted to be positioned adjacent a top side of each respective hollow rung upon said fixed arm extension through the respective hollow rung, said top side of each said fixed arm adapted to preclude rotation of said respective fixed arm within the respective rung.

4. The device as claimed in claim 1 further comprising a second flange depending from said tray base, said second flange adapted for engaging a clip of a paint tray positioned atop said tray base.

5. The device as claimed in claim 1 wherein said tray further comprises:

a pair of side walls atop said base;

an end wall extending between said side walls;

a panel extending from one of said sidewalls and presenting apertures therein for engagement of selected accessories therewith.

6. The device as claimed in claim 5 further comprising a plurality of apertures in at least one of said side walls, said side wall apertures adapted to engage a hook therein for suspending selected accessories from the hook.

7. The device as claimed in claim 1 wherein said aperture in said at least one flange comprises an arcuate slot.

8. The device as claimed in claim 1 further comprising a second aperture in said brace adapted to engage a hook therein for suspension of a selected accessory from the hook.

9. The device as claimed in claim 1 wherein said pin means has a first depressed position and a second extended position relative to said slidable arm, a depression of said pin means allowing for initial insertion of said slidable arm within said fixed arm, an alignment of said slot with said depressed pin means allowing for said pin means to extend into said slot in said engagement therebetween.

10. The device as claimed in claim 1 wherein said at least one depending flange comprises:

first and second depending flanges at a spaced-apart relationship therebetween, a portion of said brace positioned between said depending flanges.

11. The device as claimed in claim 1 wherein said fastener means comprises:

a bolt for extension through said aligned apertures, said bolt providing said pivot axis;

a nut for engagement at an end of said bolt, a tightening of said nut urging said at least one tray flange against said brace with a loosening of said nut displacing said at least one tray flange from said brace.

12. An accessory device for installation on a ladder having hollow rungs extending through a pair of spaced-apart rails comprising:

an upper arm assembly having a first fixed arm adapted to fit within a hollow rung of a ladder and a second slidable arm within said first arm;

a lower arm assembly having a first fixed arm adapted to fit within a lower hollow rung of the ladder and a second slidable arm within said first arm;

a slot in each said fixed arm;

a pin on each said slidable arm for engagement with said slot, each said pin slidable along each said slot upon a user exertion on each said slidable arm, said pin engagement with said respective slot precluding a relative movement between said respective fixed and slidable arms absent a user exertion on said slidable arm;

a brace attached to said second slidable arms of each arm assembly;

an aperture in said brace;

a tray having a base;

at least one flange depending from said base;

an aperture in said flange;

fastener means for defining a pivot axis extending through said brace and flange apertures upon alignment therebetween, said fastener means movable between a first position bearing against said at least one depending flange for precluding a movement of said depending flange about said pivot axis and a second position displaced from said at least one depending flange for allowing for said pivotal movement, whereby said fastener means and said slidable arms selectably position and maintain said tray at lateral and pivotal positions relative to the ladder.

13. The device as claimed in claim 12 wherein said fastener means comprises:

a bolt for extension through said aligned apertures, said bolt providing said pivot axis;

a nut for engagement at an end of said bolt a tightening of said nut urging said at least one tray flange against said brace with a loosening of said nut displacing said at least one tray flange from said brace.

14. A support device in combination with a ladder having hollow rungs extending through a pair of spaced-apart rails comprising:

a first arm slidable along a first rung of the ladder;

a second arm slidable along a second rung of the ladder;

a slot extending along each of the first and second rungs of the ladder;

a tray;

means for pivotally mounting said tray to said slidable arms in movement therewith;

a pin at an end of each slidable arm respectively slidable along each slot in the first and second ladder rungs, each said pin configured for a friction fit engagement within the respective slot whereby to position and maintain said slidable arms in extension from the rungs with said tray mounted thereto.

15. The device as claimed in claim 14 wherein said pivot mounting means comprises:

a brace attached to said slidable arms;

a flange depending from said tray;

means for pivotally mounting said flange to said brace.

16. An accessory device for installation on a ladder having hollow rungs extending through a pair of spaced-apart rails comprising:

at least one arm assembly having a first fixed arm adapted to fit within a hollow rung of a ladder and a second slidable arm within said first arm;

a slot extending along one of said first or second arms of said at least one arm assembly;

a pin on the other of said first or second arms of said at least one arm assembly for movement along said slot upon said slidable movement of said second arm relative to said first arm, said pin in engagement with said slot absent said slidable movement to maintain said second slidable arm at a selectable lateral position relative to said first fixed arm;

a brace attached to said second slidable arm of said at least one arm assembly;

a tray;

means for mounting said tray to said brace whereby said fastener means and said slidable arms position and maintain said tray at selectable lateral and pivotal positions relative to the ladder.

17. The device as claimed in claim 16 wherein said mounting means comprises:

an aperture in said brace;

a flange depending from said tray;

an aperture in said depending flange;

fastener means for defining a pivot axis extending through said apertures upon alignment therebetween, said depending flange movable about said pivot axis whereby to pivot said tray attached thereto.

18. An accessory device for installation on a ladder having hollow rungs extending through a pair of spaced-apart rails comprising:

a first arm assembly having a configuration for insertion within a first hollow rung of a ladder, said first arm assembly comprising:

a fixed arm adapted for insertion within the respective first hollow rung;

a slidable arm within said fixed arm and slidable between a first position within said fixed arm and a second position extensible from said fixed arm;

a second arm assembly having a configuration for insertion within a second hollow rung of the ladder, said second arm assembly comprising:

a fixed arm adapted for insertion within the respective second hollow rung;

a slidable arm within said fixed arm and slidable between a first position within said respective fixed arm and a second position extensible from said respective fixed arm;

a slot in each said fixed arm;

pin means on each said slidable arm for engagement with said slot, said pin means slidable along said slot upon a user exertion on said slidable arms, said pin means engagement with said slot precluding a relative movement between said fixed and slidable arms absent a user exertion on said slidable arms, said slidable arms presenting a support structure adapted for attachment of an accessory thereto whereby to position and maintain the accessory at selectable positions relative to the ladder.

19. An accessory device for installation on a ladder having hollow rungs extending through a pair of spaced-apart rails comprising:

at least one arm assembly having a first fixed arm adapted to fit within a hollow rung of a ladder and a second slidable arm within said first arm;

a slot extending along one of said first or second arms of said at least one arm assembly;

a pin on the other of said first or second arms of said at least one arm assembly for movement along said slot upon said slidable movement of said second arm relative to said first arm, said pin in engagement with said slot absent said slidable movement to maintain said second slidable arm at a selectable lateral position relative to said first fixed arm, said slidable arm presenting a support structure adapted for attachment of an accessory thereto whereby to position and maintain the accessory at selectable lateral positions relative to the ladder.

* * * * *